United States Patent [19]

Temler

[11] 4,229,251

[45] Oct. 21, 1980

[54] HIGH-YIELD SEMI-CHEMICAL CARBONATE PULPING PROCESS

[75] Inventor: Jan S. Temler, Beaconsfield, Canada

[73] Assignee: Domtar, Inc., Montreal, Canada

[21] Appl. No.: 672,138

[22] Filed: Mar. 31, 1976

Related U.S. Application Data

[63] Continuation-in-part of Ser. No. 545,796, Jan. 31, 1975, abandoned.

[30] Foreign Application Priority Data

Dec. 9, 1974 [CA] Canada ..... 215531

[51] Int. Cl.[3] ..... D21C 3/02; D21C 11/12

[52] U.S. Cl. ..... 162/28; 162/30 R; 162/90

[58] Field of Search ..... 162/20, 28, 90, 30 R, 162/24

[56] References Cited

U.S. PATENT DOCUMENTS

| | | | |
|---|---|---|---|
| 1,857,433 | 5/1932 | Codwise | 162/24 |
| 2,454,532 | 11/1948 | Walter | 162/90 X |
| 3,186,899 | 6/1965 | Madison et al. | 162/24 |
| 3,388,037 | 6/1968 | Asplund et al. | 162/28 X |
| 3,811,995 | 5/1974 | Ringley | 162/19 |
| 3,862,909 | 1/1975 | Copeland | 162/30 R |
| 4,073,678 | 2/1978 | Hammond | 162/90 X |

FOREIGN PATENT DOCUMENTS 739865 5/1977 Canada .

OTHER PUBLICATIONS

Christiansen, "Effect of Sulfite Carbonate Ratio on Neutral Sulfite Semichemical Pulping", *TAPPI*, vol. 43, No. 6, Jun. 1960.

"The Pulping of Wood", *Pulp and Paper Manufacture*, vol. I, Second Ed., McGraw Hill Book Co., N.Y., 1969, pp. 226–244.

Winczakiewicz and Kaszynski, "Papier, Carton, Cellulose", 14, No. 1, 96–98, 1965.

Aronousky et al., "The Cooking Process", Industrial and Engineering Chemistry, vol. 22, No. 9, pp. 941–945.

*Primary Examiner*—S. Leon Bashore
*Assistant Examiner*—Steve Alvo
*Attorney, Agent, or Firm*—C. A. Rowley

[57] ABSTRACT

High-yield pulp suitable for the production of corrugating medium is produced by cooking hardwood chips at a temperature 180°–192° with sodium carbonate solutions of a concentration 65 to 120 g/l as $Na_2O$, at a liquor to wood ratio of 1.2–2.5, and mechanically refining the cooked chips in a primary refining stage to a C. S. Freeness less than 480, and then refining the pulp in a secondary refining stage.

9 Claims, 1 Drawing Figure

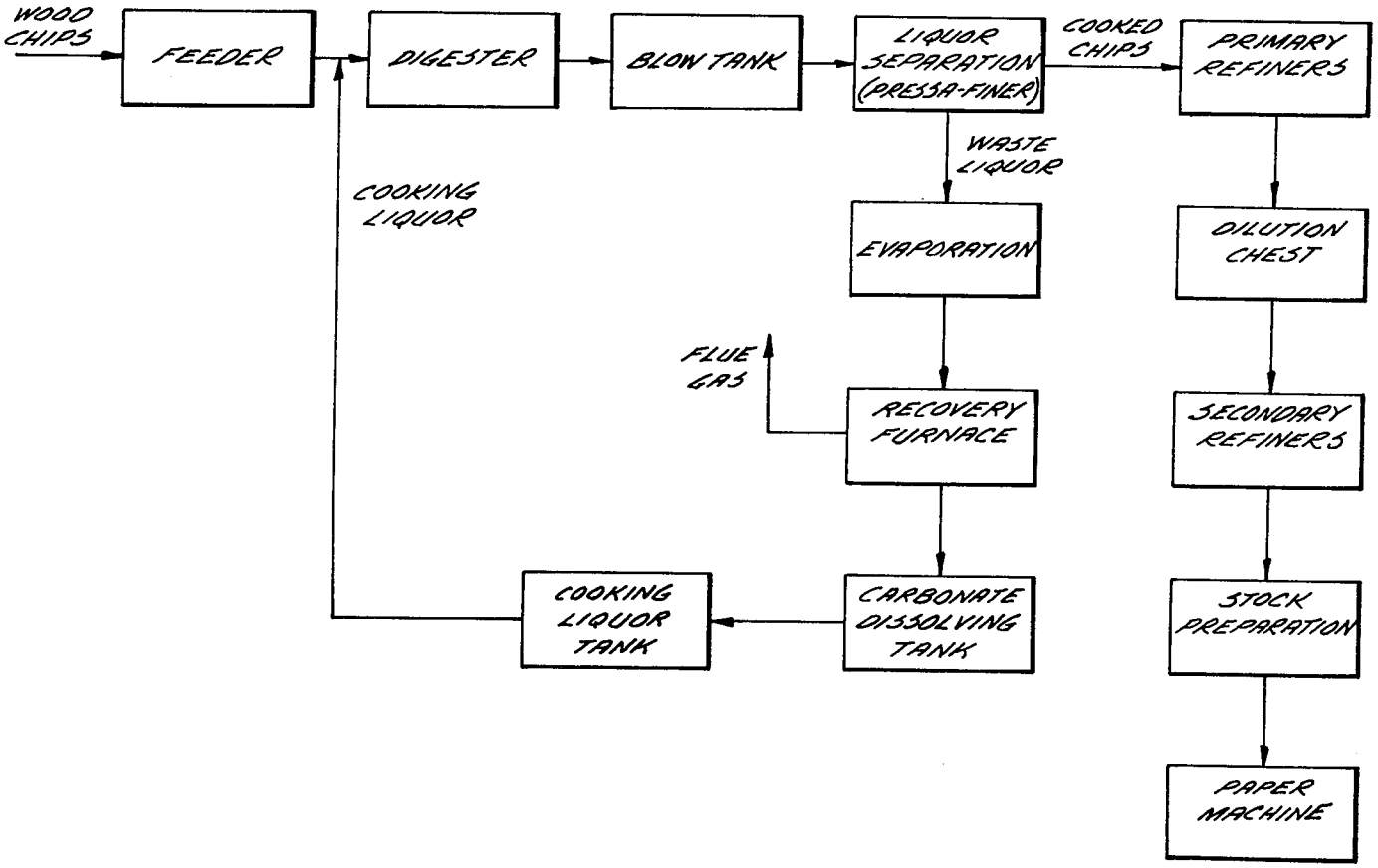
WOOD CHIPS
FEEDER
DIGESTER
BLOW TANK
LIQUOR SEPARATION (PRESSA-FINER)
COOKED CHIPS
PRIMARY REFINERS
DILUTION CHEST
SECONDARY REFINERS
STOCK PREPARATION
PAPER MACHINE
COOKING LIQUOR
WASTE LIQUOR
EVAPORATION
RECOVERY FURNACE
FLUE GAS
CARBONATE DISSOLVING TANK
COOKING LIQUOR TANK

HIGH-YIELD SEMI-CHEMICAL CARBONATE PULPING PROCESS

This application is a continuation-in-part of U.S. application Ser. No. 545,796 filed Jan. 31, 1975, now abandoned.

FIELD OF THE INVENTION

The present invention relates to a process for the production of pulp. It relates more particularly to a process for producing semi-chemical pulp from hardwood using sodium carbonate as substantially the sole pulping chemical and to the recovery of the pulping chemical for re-use in the pulping process.

THE PRIOR ART

Semi-chemical pulps are conventionally produced by the neutral sulphite process (NSSC) in which wood chips or similar raw material is cooked at a suitable temperature with a pulping liquor consisting of a mixture of sodium carbonate and sodium sulphite, and the resulting partly delignified material is defiberized by mechanical refining. The carbonate has long been considered an inert chemical as far as cooking processes are concerned, and its role in the neutral sulphite liquor has been considered essentially passive; however, Aronovsky et al (Industrial and Eng's Chem., September, 1930, p. 941) have shown that it is possible to cook wood particles with carbonate liquors when high chemical to wood ratios and relatively long cooking periods are used. Christiansen (TAPPI, June, 1960, p. 586) has also shown that the carbonate component in the neutral sulfite process had an appreciable pulping effect.

The recovery of chemicals from spent liquors in the NSSC process has always presented certain difficulties. However, in certain cases, e.g. where the NSSC process is practiced next door to a Kraft mill, it is possible to combine the waste liquors from both mills and to process the combined liquors in the Kraft recovery system. Conditions for such cross-recovery, obviously, do not always exist and even where they exist, problems arise, e.g. in respect of the sulphur-sodium balance in the Kraft system. In practice, for such cross recovery of combined effluents to be feasible, the Kraft mill must be many times greater than the associated NSSC mill, and this usually puts restraints on the size of the NSSC mill which may be otherwise undesirable.

U.S. Pat. No. 3,811,995 proposes a process wherein the wood is cooked with a Kraft green liquor and the cooked wood is mechanically refined at a pH between 9 and 13. While the process is evidently designed for the operation of a semi-chemical mill in conjunction with a Kraft mill as a cross recovery operation, it also discloses pulping with 100% sodium carbonate; however, the carbonate pulps, particularly those of a yield above 78%, are markedly inferior to the pulps obtained with green liquor, and probably unusable. Winczakiewicz and Kaszynska (Paper, Carton, Cellulose, 14 (1): 96–98 (1965) ) reported laboratory results of semi-chemical pulping of hardwoods with sodium carbonate at 170° C., resulting in yields of 85 percent and higher.

SUMMARY OF THE INVENTION

The object of the invention is to provide a process for producing semi-chemical pulp by cooking wood material with a liquor consisting essentially of sodium carbonate. Another object of the invention is to provide a sulphur-free process for producing semi-chemical pulp suitable for use in corrugating medium and for recovering the chemicals in a recovery system free of any dependence on a Kraft mill.

The present invention provides a process for producing semi-chemical pulp suitable for the manufacture of corrugating medium comprising mixing hardwood chips with a liquor consisting essentially of a solution of sodium carbonate, cooking the chips with said liquor at a temperature between 170° and 200° C. for a period of 8–60 minutes, mechanically refining the hot cooked chips in a primary refining stage to a Can. Standard Freeness below 480, and then refining the pulp in a secondary refining stage. The invention further provides a cyclic process wherein the residual liquor separated from the cooked chips is burnt in a recovery furnace to produce heat and a sodium carbonate residue and the sodium carbonate is reused for the making of the cooking liquor.

THE DRAWING

The single FIGURE in the drawing represents a schematic flow diagram illustrating the cyclic process of pulping and recovery of the present invention.

DETAILED DESCRIPTION OF THE INVENTION

The process of the invention can be carried out in conventional equipment, e.g. in equipment originally installed for an NSSC mill. The cooking liquor in this process is a sodium carbonate solution. The inorganic product of ordinary oxidative combustion of the spent liquor from this process is also sodium carbonate which can be thus directly re-used for the making of pulping liquor, thereby making the present process of pulping and recovery a truly cyclic one and of great simplicity. When semi-chemical pulp is prepared in accordance with the present process, notably when the primary refining is carried to a Freeness below 480, and the resulting pulps are refined in a secondary refining stage to the conventional freeness values used on a paper machine, the medium produced will have a Concora value which is substantially of the same order as that produced from NSSC pulps.

Referring to the drawing, wood chips are mixed with the cooking liquor and fed to the digester where they are subjected to a digestion temperature and pressure. The techniques of mixing the chips with liquor, the method of feeding, the type of digester, etc. may vary widely and are generally known in the art. In a preferred embodiment the chips are passed through a conically shaped feeder which compresses them during passage, then they are sprayed with liquor in suitable quantity and fed to a digester through which they are passed continuously, while steam is injected into the digester to maintain it at the cooking temperature and pressure. The cooking liquor is a solution of sodium carbonate of a suitable concentration. It is preferred to use liquors of a concentration between 65 and 120 g/l in terms of $Na_2O$, and to add liquor to the chips in such amounts that the liquor to wood ratio, including moisture contained in the chips, is between 1.2 and 2.5 to 1. This is a relatively low ratio compared with conventional cooking and in practice resembles a vapour phase cook. It is obviously necessary to ensure that this relatively small amount of liquor is suitably distributed among the chips to ensure relatively uniform cooking.

The charge of carbonate (as $Na_2O$) on o.d. wood is about 5–12%.

The digestion temperature is maintained, e.g. by steam injection, at between 170° and 200°, preferably at 180°–192° C., and at the latter temperatures a time of 8–30 minutes is sufficient to produce a pulp at a yield below about 85%. Yields between 70% and 85% can be obtained, which are somewhat higher than those obtained in NSSC cooking in corresponding conditions. By refining the cooked wood, immediately upon cooking in a primary refining stage to a lower freeness than is conventionally done, at any rate a C.S. Freeness less than 480, strength properties, particularly Concora, are subsequently obtained which are almost equal to NSSC pulps of generally lower yields.

Referring again to the drawing, the cooked and softened chips are removed from the digester and separated from the residual liquor, e.g. by passing them through a Pressa-finer in which the residual liquor is squeezed out from the chips while the chips are partially broken up. The chips are then passed to primary refining stations where complete mechanical defibration takes place. The refining is carried to a freeness of about 480 and less, preferably in the range of about 400–480 CSF, care being taken, however, not to carry the refining to a point where other properties of the pulp may be deleteriously affected.

The pulp is then suspended in water at a suitable dilution, and if desired, mixed with secondary fibers, and then passed on to secondary refining stations. The secondary refining is carried out essentially in a conventional manner to bring the stock to a freeness usually required on a paper machine, i.e. to a freeness of the order of 150–250 CSF. It will be appreciated that the pulp suspension, prior to being fed to the paper machine, is diluted, usually in a number of steps, to bring the stock to the usual consistency of about 1%, more or less. For environmental reasons the dilution is carried out is some mills, at least partially, by means of return white water which tends to lower the freeness of the stock. In such cases, secondary refining is stopped at a freeness somewhat higher than the final freeness required on the paper machine to allow for the drop in freeness caused by the addition of white water. Generally, secondary refining will be carried to a freeness of about 180–350 CSF and in any case to a freeness such that the (diluted) stock, fed to the paper machine, has a freeness about 150–250 CSF.

The residual liquor removed from the softened chips is then processed in a simple manner to recover the carbonate for re-use. A preferred method is to burn the liquor in a furnace of the fluidized bed type, such as described, e.g. in Canadian Pat. No. 739,865 to Container Corporation of America. The residual liquor, concentrated if necessary, is introduced into a fluidized bed of solid particles at a temperature at which the organic content of the liquor is burnt out substantially completely, while the inorganic residual material is deposited, without melting, on the said particles. The heat generated by combustion and carried by the flue gases can be utilized in the mill in a variety of known ways. The inorganic residual material consists essentially of sodium carbonate: while portion of the material is kept in the furnace and continues to be used as the mass of particles forming the fluidized bed, another portion is discharged and re-used for the preparation of new cooking liquor. The simplicity of the recovery operation is striking, for only a single chemical compound, sodium carbonate, is used in the cooking, and the same chemical is obtained, without the need for separation from other compounds on for further processing, as a result of combustion of the waste liquor. The residual liquor may have to be concentrated, as illustrated in the drawing, e.g. to about 50% solids, but in many cases, especially when the liquor is separated from the cooked chips by pressing, e.g. in a Pressa-finer, there may be no need for concentrating the effluent which may then be fed directly to the furnace. It will be evident that the invention may be practiced only in its pulping aspect, without recovery. But even if no recovery is contemplated but only disposal of the waste liquor, e.g. by ponding, major environmental problems are avoided by the use of a non-sulfur liquor, particularly one where the chemical remaining in the effluent is the essentially harmless sodium carbonate.

The pulps obtained by the process of the invention lend themselves easily to conversion to corrugating medium by conventional methods. The major test for corrugating medium is Concora strength (CPPA Standard D24) and on the basis of this test industry specifications classify medium into three grades, namely grade A with Concora greater than 71, grade B with Concora between 71 and 66, and grade C with Concora between 66 and 62. In mill trials and in subsequent mill operation, mediums produced by the present process averaged over 40% of grade A, and close to 50% of grade B, while the runnability of the medium at machine speeds of 1100–1200 ft/min. was substantially of the same order as conventional NSSC.

While cooking wood with sodium carbonate was known per se, the resulting pulps have not been hitherto commercially satisfactory. The present process, using cooking conditions as herein described, combined with primary refining to a relatively low freeness, permits the production of semi-chemical pulps which have sufficient strength to be used effectively in corrugated medium of good quality, though of lower brightness than medium from NSSC.

The following examples are given for purposes of illustration and are not to be interpreted as limiting the invention to the particular embodiments disclosed.

EXAMPLE 1

In a corrugating medium mill of a daily capacity of 200 ADT, which normally operated as an NSSC mill, a five-day trial was carried out using sodium carbonate as the sole cooking chemical for the cooking of wood. A mixture of hardwood chips, consisting of maple, elm, oak, birch, beech and poplar, with hard maple predominating, was fed to a continuous Pandia digester through a screw-feeder of relatively high compression. The chips had the usual size distribution with about 85% being between 1" and ¼". At the outlet from the screw-feeder, cooking liquor consisting of an aqueous solution of sodium carbonate of a concentration between 167 and 176 g/l (in terms of $Na_2CO_3$) was sprayed onto the chips. The amount of liquor was adjusted to ensure a charge of about 8.8% carbonate expressed as $Na_2O$ on O.D. wood, and a liquor to wood ratio was maintained of about 2:1 (including the moisture present in the entering chips). The mixture was then cooked in the digester at a pressure of 158 psi (corresponding to a temperature of about 188° C.) for 16-½ minutes.

The cooked material was collected into a blow tank and fed under atmospheric pressure to a Pressa-finer where the spent liquor was partly squeezed out of the chips. The pressed hot chips were then refined at a consistency of about 16% in a battery of primary refiners to a freeness of 450 CSF. The pH of the mixture during refining was between 8.1 and 8.5. The pulp yield was 81–82%, compared with an average yield during regular NSSC pulping of 77.5%. The spent liquor had a $Na_2CO_3$ concentration of between 14 and 21 g/l, and had a pH about 9.0.

The pulp issuing from the refiners was then further processed substantially in the same manner as was conventionally done in the NSSC mill namely: The pulp was collected in the brown stock chest and diluted with white water from the paper machine to a consistency of about 4%. It was then mixed with slushed box plant clipping in the amount of about 20–30% of the total mixture, the blended stock was refined in secondary refiners, and then further diluted to about 1% consistency, and then pumped to the head-box of the paper machine. The stock pumped to the head box had a freeness of about 200 CSF.

The properties of the medium produced were as follows:

| ROLL NO. | CONCORA | STIFFNESS (H. & D.) | BRIGHTNESS No. 8 |
|---|---|---|---|
| 13133/34 | 69 | 71 | 8 |
| 13266/67 | 73 | 77 | 8 |
| 13400/01 | 71 | 75 | 8 |
| 13432/33 | 78 | 76 | 8 |
| 13572/73 | 69 | 73 | 8 |

The runnability of the medium on a paper machine at speeds of about 1100 ft/min. was as good as that of NSSC medium.

EXAMPLE 2

This Example provides a comparison between pulps produced by the process of the invention and NSSC pulps, and also illustrates the importance of the primary refining. The pulps were produced in the same mill as in Example 1, using the same mixtures of hardwood chips, but four of them were produced with NSSC liquor and five with a liquor containing only carbonate. The pulps were processed into corrugating mediums in the same manner as in Example 1. The conditions of pulping and the properties of the medium were as follows:

| | LIQUOR | | | | CARBONATE LIQUOR | | | | |
|---|---|---|---|---|---|---|---|---|---|
| ROLL NO. | 2437 | 5296 | 12905 | 13055 | 2642 | 5592 | 13616 | 73460 | 73648 |
| LIQUOR CONCENTRATION g/l | 120s* 80c* | 100s* 79c* | 99s* 78c* | 110s* 76c* | 188** | 160** | 175** | 200* | 187** |
| LIQUOR TO WOOD RATIO | 1.8:1 | 1.8:1 | 1.8:1 | 1.8:1 | 1.9:1 | 2.2:1 | 2:1 | 1.8:1 | 2:1 |
| TEMPERTURE ° C. | 188 | 188 | 187 | 187 | 188 | 188 | 187 | 189 | 189 |
| TIME AT TEMP. (MIN.) | 15.5 | 15.5 | 15.5 | 15.5 | 15.5 | 16.5 | 16.5 | 16.5 | 16.5 |
| PRIMARY REFINING TO FREENESS (CSF) | 510 | 510 | 510 | 500 | 510 | 500 | 450 | 450 | 450 |
| YIELD % | 75 | 76 | 76 | 75 | 80 | 8 | 79 | 80 | 80 |
| BURST FACTOR | — | — | — | 17 | — | — | 16 | — | — |
| TEAR FACTOR | | | | | | | | | |
| MD | — | — | — | 66 | — | — | 55 | — | — |
| CD | — | — | — | 63 | — | — | 54 | — | — |
| TENSILE | | | | | | | | | |
| MD | — | — | — | 4.2 | — | — | 4.0 | — | — |
| CD | — | — | — | 2.1 | — | — | 2.0 | — | — |
| CONCORA (Lbs) | 73 | 72 | 72 | 69 | 60 | 61 | 73 | 72 | 73 |
| STIFFNESS (H&D) | 81 | 76 | 74 | 71 | 64 | 71 | 76 | 76 | 72 |
| BRIGHTNESS #8 | 17 | 16 | 16 | 17 | 8.2 | 8.8 | 8.0 | 8.2 | 8.5 |

*s - Sodium sulfide
*c - Sodium carbonate
**in terms of $Na_2CO_3$

EXAMPLE 3

This Example provides further examples of pulps obtained by the process of the invention in commercial scale operations in the same mill. The conditions of the process were essentially the same as in Example 1, except that the liquor concentration was between 185 and 203 g/l of $Na_2CO_2$, the charge of chemical as $Na_2O$ on wood was 8.1% and the liquor to wood ratio was 1.8:1. The mixture was cooked in the digester at a pressure of 164 psi (corresponding to a temperature of about 189° C.). The primary refining was done a CSF of 450. The properties of the medium obtained were:

| ROLL NO | CONCORA | STIFFNESS | BRIGHTNESS NO. 8 |
|---|---|---|---|
| 73436/37 | 69 | 71 | 8.0 |
| 73460/61 | 72 | 76 | 8.0 |
| 73500/01 | 76 | 74 | 8.0 |

The runnability of the medium on the paper machine at speeds of about 1200 ft/min. was substantially as good as that of NSSC medium.

EXAMPLE 4

This Example provides further examples of making pulp by the process of the invention, in commercial scale operation in the same mill, in which the primary refining was carried to various values below 480. The conditions of the process were essentially the same as in Example 1, using the same mixtures of hardwood chips, and using liquor concentration and liquor to wood ratios as stated below. The pulp yield was in the 79–81% range. After primary refining, the pulp was diluted with white water and mixed with slushed box plant chipping and the blended stock was refined in secondary refiners as in Example 1. After further dilution to the required consistency, the stock now having a freeness of about 175–225 CSF, was pulped to the head-box of the paper machine.

| Roll No. | 89349 | 89972 | 88537 | 88349 | 98093 | 98491 | 99343 |
|---|---|---|---|---|---|---|---|
| Liquor Concentration (Carbonate, g/l | 195 | 191 | 193 | 192 | 172 | 173 | 184 |
| Liquor to wood ratio | 2.0:1 | 1.9:1 | 2.0:1 | 1.9:1 | 2.2:1 | 2.0:1 | 1.9:1 |
| Temperature (° C.) | 189 | 189 | 189 | 188.5 | 189 | 188 | 189 |
| Time at temp. (Min.) | 16 | 16 | 16 | 16 | 16 | 16½ | 16½ |
| Primary refining (freeness, CSF) | 434 | 443 | 436 | 458 | 470 | 475 | 480 |
| Concora (lb) | 75 | 72 | 74 | 74 | 75 | 70 | 72 |
| Stiffness (H & D) | 73 | 70 | 72 | 72 | 72 | 71 | 75 |
| Brightness No. 8 | 8.4 | 8.1 | 8.2 | 8.6 | 8.1 | 8.3 | 8.4 |

While the invention has been particularly described with reference to preferred embodiments thereof, it is understood that various changes and modifications thereof will occur to a person skilled in the art without departing from the scope of the invention as defined by the claims.

What is claimed:

1. A method of producing high-yield semi-chemical pulp suitable for the manufacture of corrugating medium comprising mixing hardwood chips with a liquor consisting essentially of an aqueous solution of sodium carbonate having a concentration of carbonate between 65 and 120 grams per liter expressed as $Na_2O$, cooking the chips with said liquor at a temperature between 170° C. and 200° C. to a pulp yield of about 70–85%, separating the cooked chips from residual liquor and immediately thereafter passing said chips to a primary refining state, mechanically refining the cooked chips in said primary refining state to a pulp of a C.S.F. value not greater than 480, and mechanically refining said pulp in a secondary refining stage.

2. The method of claim 1 wherein said cooking is carried out in a continuous digester with a liquor to wood ratio between 1.2 and 2.5 and a charge of chemical on wood between 5 and 12%.

3. The method of claim 2 wherein the cooking temperature is maintained between 180° C. and 192° C. for a time between 8 and 30 minutes.

4. The method of claim 3 wherein said cooked chips are refined in said primary refining stage to a pulp of a C.S.F. value of 400–480.

5. The method of claim 3 wherein said pulp is refined in said secondary refining stage to a C.S.F. value of 180–350.

6. The method of claim 1 wherein said cooked chips are refined in said primary refining stage to a pulp of a C.S.F. value of 400–480.

7. The method of claim 1 wherein said pulp is refined in said secondary refining stage to a C.S.F. value of 180–350.

8. The method of claim 1 wherein the liquor separated from the pulp is burnt in oxidative conditions in a recovery furnace to produce heat and a sodium carbonate residue and said sodium carbonate is re-used for the making of the cooking liquor.

9. The method of claim 1 wherein the liquor separated from the pulp is fed to a fluidized bed recovery furnace, the fluidized bed being formed of particles of sodium carbonate, the liquor is burnt in said fluidized bed to produce heat and a residue consisting of particles of sodium carbonate, and at least a portion of said particles of sodium carbonate is reused for the making of cooking liquor.

* * * * *